US009371657B2

(12) United States Patent
Braun

(10) Patent No.: US 9,371,657 B2
(45) Date of Patent: Jun. 21, 2016

(54) WORKING DEVICE WITH STATIONARY BOOM AND ROTARY HEAD

(71) Applicant: Putzmeister Engineering GmbH, Aichtal (DE)

(72) Inventor: Matthias Braun, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 14/767,941

(22) PCT Filed: Jan. 21, 2014

(86) PCT No.: PCT/EP2014/051113

§ 371 (c)(1),
(2) Date: Aug. 14, 2015

(87) PCT Pub. No.: WO2014/135297

PCT Pub. Date: Sep. 12, 2014

(65) Prior Publication Data

US 2015/0376908 A1 Dec. 31, 2015

(30) Foreign Application Priority Data

Mar. 7, 2013 (DE) ..... 10 2013 203 885

(51) Int. Cl.
*F16L 3/00* (2006.01)
*E04G 21/04* (2006.01)

(52) U.S. Cl.
CPC ..... *E04G 21/0427* (2013.01); *E04G 21/0445* (2013.01)

(58) Field of Classification Search
USPC ..... 248/49
See application file for complete search history.

(56) References Cited

U.S. PATENT DOCUMENTS 3,608,742 A 9/1971 Adolfsson et al.
4,180,170 A * 12/1979 Meinken ..... B66C 23/18 137/615

(Continued)

FOREIGN PATENT DOCUMENTS

CN 202 248 914 U 5/2012
DE 17 81 099 A 10/1970

(Continued)

OTHER PUBLICATIONS

International Search Report of PCT/EP2014/051113, mailed Apr. 1, 2014.

(Continued)

*Primary Examiner* — Monica Millner
(74) *Attorney, Agent, or Firm* — Collard & Roe, P.C.

(57) ABSTRACT

A working device has a base designed as a stationary support column, a motor-driven rotary head and a stack of arms made up of several mast arms which can be moved with respect to each other in pairs, using articulated or sliding joints, supporting a concrete transport line. The stack of arms is articulated on the rotary head about a horizontal rotational axis by a first mast arm. The working device also includes a control mechanism which can be actuated by a control element or a radio path and which is arranged in a control box, and a hydraulic assembly including an oil tank and a motor-driven hydraulic pump for controlling working groups for moving the rotary head and mast arm. A working platform fixed with respect to the base is arranged in the region of the bearing block for emergency operations. In order to ensure that the components required for actuating the stack of arms are not in the way of the engine in the event of an emergency operation, the control box with the control mechanism and the hydraulic assembly with the oil tank and hydraulic pump are arranged on the rotary head above the bearing block.

10 Claims, 6 Drawing Sheets

(56) References Cited

U.S. PATENT DOCUMENTS

| | | | | | |
|---|---|---|---|---|---|
| 4,505,397 | A * | 3/1985 | Isogai | B66C 23/18 | 137/615 |
| 4,582,205 | A * | 4/1986 | Berger | B66C 13/52 | 212/175 |
| 4,624,357 | A * | 11/1986 | Oury | E04G 21/04 | 198/313 |
| 5,393,193 | A * | 2/1995 | Dagg | B60P 1/5433 | 188/72.8 |
| 5,807,059 | A * | 9/1998 | Takeda | E04G 21/04 | 198/317 |
| 6,226,955 | B1 | 5/2001 | Lorrigan | | |
| 6,475,058 | B2 * | 11/2002 | Mammano | A63H 33/3044 | 446/425 |
| 6,675,822 | B1 | 1/2004 | Schmitz et al. | | |
| 7,258,242 | B2 * | 8/2007 | Irsch | B66C 13/18 | 212/168 |
| 7,631,659 | B2 | 12/2009 | Schneider et al. | | |
| 7,748,193 | B2 * | 7/2010 | Knigge | B66C 23/286 | 212/176 |
| 8,109,291 | B2 * | 2/2012 | Fuegel | B66C 23/32 | 137/615 |
| 2005/0271522 | A1 * | 12/2005 | Leibbrand | B60P 3/16 | 417/234 |
| 2006/0137750 | A1 * | 6/2006 | Alwes | B66C 23/42 | 137/615 |
| 2007/0175849 | A1 * | 8/2007 | Yokoyama | B66C 23/82 | 212/180 |
| 2011/0196583 | A1 * | 8/2011 | Petzold | B66C 23/78 | 701/50 |

FOREIGN PATENT DOCUMENTS

| | | | |
|---|---|---|---|
| DE | 33 11 736 | A1 | 10/1984 |
| DE | 295 21 389 | U1 | 2/1997 |
| DE | 100 49 927 | A1 | 4/2002 |
| EP | 1 235 965 | B1 | 9/2002 |
| JP | 2008-202232 | A | 9/2008 |
| WO | 86/00279 | A1 | 1/1986 |
| WO | 2008/055282 | A1 | 5/2008 |

OTHER PUBLICATIONS

German Search Report in DE 10 2013 203 885.2, dated Dec. 16, 2013, with English translation of relevant parts.

* cited by examiner

WORKING DEVICE WITH STATIONARY BOOM AND ROTARY HEAD

CROSS REFERENCE TO RELATED APPLICATIONS

This application is the National Stage of PCT/EP2014/051113 filed on Jan. 21, 2014, which claims priority under 35 U.S.C. §119 of German Application No. 10 2013 203 885.2 filed on Mar. 7, 2013, the disclosure of which is incorporated by reference. The international application under PCT article 21(2) was not published in English.

BACKGROUND OF THE INVENTION

The invention relates to a working device having a frame configured preferably as a stationary support column, having a motor-driven rotary head which is arranged on a bearing block, fixed to the frame, so as to be rotatable about a vertical rotation axis, having an arm assembly consisting of a plurality of boom arms that are movable in pairs, relative to one another at articulated joints or sliding joints and carry a concrete delivery line, which arm assembly is articulated on the rotary head about a horizontal rotation axis by way of its first boom arm, having a control mechanism that is actuable either via control members or a radio link and is arranged in a control cabinet, and a hydraulic assembly, having an oil tank and a motor-driven hydraulic pump, for controlling drive units for the rotary-head and boom-arm movement, and having a working platform arranged in a manner fixed to the frame in the vicinity of the bearing block.

Working devices of this kind that are configured as concrete pumps have a distributor boom as outrigger, which carries a concrete delivery line that is connected to the pressure connector of a core pump arranged in a manner fixed to the frame. The drive mechanism for the rotary head usually has a drive pinion connected rigidly to the bearing block. During assembly, the bearing block with its drive pinion is first of all introduced into the drive mechanism fixed to the frame and is then screwed to the frame. In this case, a great deal of care is necessary in order that the teeth of the drive pinion are not damaged. Therefore, assembly is usually carried out at the works. On the other hand, a large number of construction sites cannot be served by mobile concrete pumps on account of a lack of space. Here, stationary frames on which the outrigger, configured as an arm assembly, is positioned are required. Such a working device having the features specified at the beginning is known per se (EP-1 235 965 B1). Therein, the components that belong to the drive mechanism of the rotary head are integrated into the bearing block fixed to the frame. This is achieved in that a drive pinion, arranged in a manner fixed to the frame, carries a coaxial alignment pin that projects beyond the frame and at least one eccentrically arranged rotary carrier element, while the rotary head has a receiving bush that is complementary to the alignment pin and is pluggable on the latter in a releasable manner, and at least one carrier part that is couplable releasably to the rotary carrier element. The separation point between the frame and the outrigger is thus located in this case between the bearing block and the rotary head, such that the relatively heavy rotary head with the drive assembly is a constituent part of the outrigger, which has to be removed from the frame during a replacement operation. A considerable disadvantage of this construction is also that the working platform is constricted by the parts attached to the support column and therefore there is not enough space for the fitter to move. In addition, the arm assembly has to be positioned a relatively long distance away from the support column, in order that collisions with fixtures on the support column are avoided. This results in a large load torque. In addition, the hose assembly necessary for hydraulically controlling the arm assembly is relatively large and bulky and further restricts the space for the fitter to move at the point in question. In the event of emergency operation, in which the fitter is active on the working platform, there is a not inconsiderable risk of injury if the rotary head with the arm assembly is controlled incorrectly. Depending on the boom position, in the event of emergency operation, the view of the fitter to the arm assembly is also impeded. Because of the relatively great height, on account of the installation parts, of the bearing block, safe assembly from the working platform is not always ensured.

SUMMMARY OF THE INVENTION

Taking this as a departure point, the invention is based on the problem of improving the known working device such that the overall height of the bearing block is kept relatively small and the fixtures necessary for the actuation of the arm assembly do not disrupt the fitter in the event of emergency operation.

In order to solve this problem, the combination of features specified in claim 1 is proposed. Advantageous configurations and developments of the invention can be gathered from the dependent claims.

The solution according to the invention consists substantially in that the control cabinet with the control mechanism and the hydraulic assembly with the oil tank and hydraulic pump are arranged on the rotary head above the bearing block. The hydraulic pump is in this case expediently driven via an electric motor which is likewise arranged on the rotary head. In this way, the freedom of movement of the fitter on the working platform in the event of maintenance and emergency operation is significantly improved. A further improvement in this regard is achieved when the drive motor necessary for driving the rotary head, and the slewing gearbox connected thereto are likewise arranged on the rotary head above the bearing block. Since the hydraulic controller is arranged in the region of the rotary head, only short fixedly ducted lines are necessary between the control device and the coupling point. The working platform free of fixtures allows the fitter to move around without stumbling and to have a good view of the arm assembly. The power connections and remote-control lines that are routed via the stationary support column are routed inside the bearing block on which there are installed coupling points, such as power outlets and quick-release connectors, which keep the working platform free. As a result of the omission of the disruptive fixtures, the arm assembly can be placed close to the rotary head, with the result that the load torque produced thereby can be reduced. As a result of all the fixtures being transferred upward into the rotary head, the bearing block can be embodied in a low manner, such that it does not disturb the freedom of movement in the region of the working platform.

An advantageous configuration of the invention provides for the control mechanism to be supplied with electric power via an external power source and an electrical cable that is routed via the support column and bridges the rotary connection between the bearing block and rotary head. A further preferred configuration of the invention provides for the oil tank to have a contour that is geometrically matched to the rotary head, a window with an internal contour that forms the passage for a ballast outrigger mounted on the rotary head remaining free in said contour.

The control cabinet for receiving the control mechanism can be arranged on a holder close to the pedestal, in order that it is reached easily by the fitter. Advantageously, provision is made of a holder for receiving the control cabinet, said holder being pivotable about an axis parallel to the rotation axis of the rotary head with respect to the window arranged on the oil tank, it being possible for said holder to be pivoted into the window when a ballast outrigger is not present or to be pivoted out of the window parallel to a ballast outrigger that is present.

A further advantageous configuration of the invention provides for the rotary head to have a base part arranged on the bearing block and an adapter piece comprising a bearing point for the arm assembly, wherein the base part and the adapter piece are coupled together releasably via a separation point. In this case, it is particularly advantageous for the base part and the adapter piece to have coupling elements that are connectable together in a form-fitting manner in pairs at their separation point. In this way, it is possible for the outrigger, together with the adapter piece, to be able to be separated from the base part of the rotary head in the region of the separation point, while the base part, together with the bearing block, remains on the frame.

According to an advantageous development of the invention, the ballast outrigger, too, is coupled releasably to the base part of the rotary head by means of further coupling elements that are connectable together in a form-fitting manner in pairs via a further adapter piece at a second separation point located opposite the separation point of the arm assembly. In order to be able to lead the ballast outrigger to the separation point, the window arranged on the oil tank has to be free by pivoting out the control cabinet located on the holder.

BRIEF DESCRIPTION OF THE DRAWING

The invention is explained in more detail in the following text with reference to an exemplary embodiment which is schematically illustrated in the drawing, in which.

DETAILED DESCRIPTION OF THE EMBODIMENTS

Figure 1:
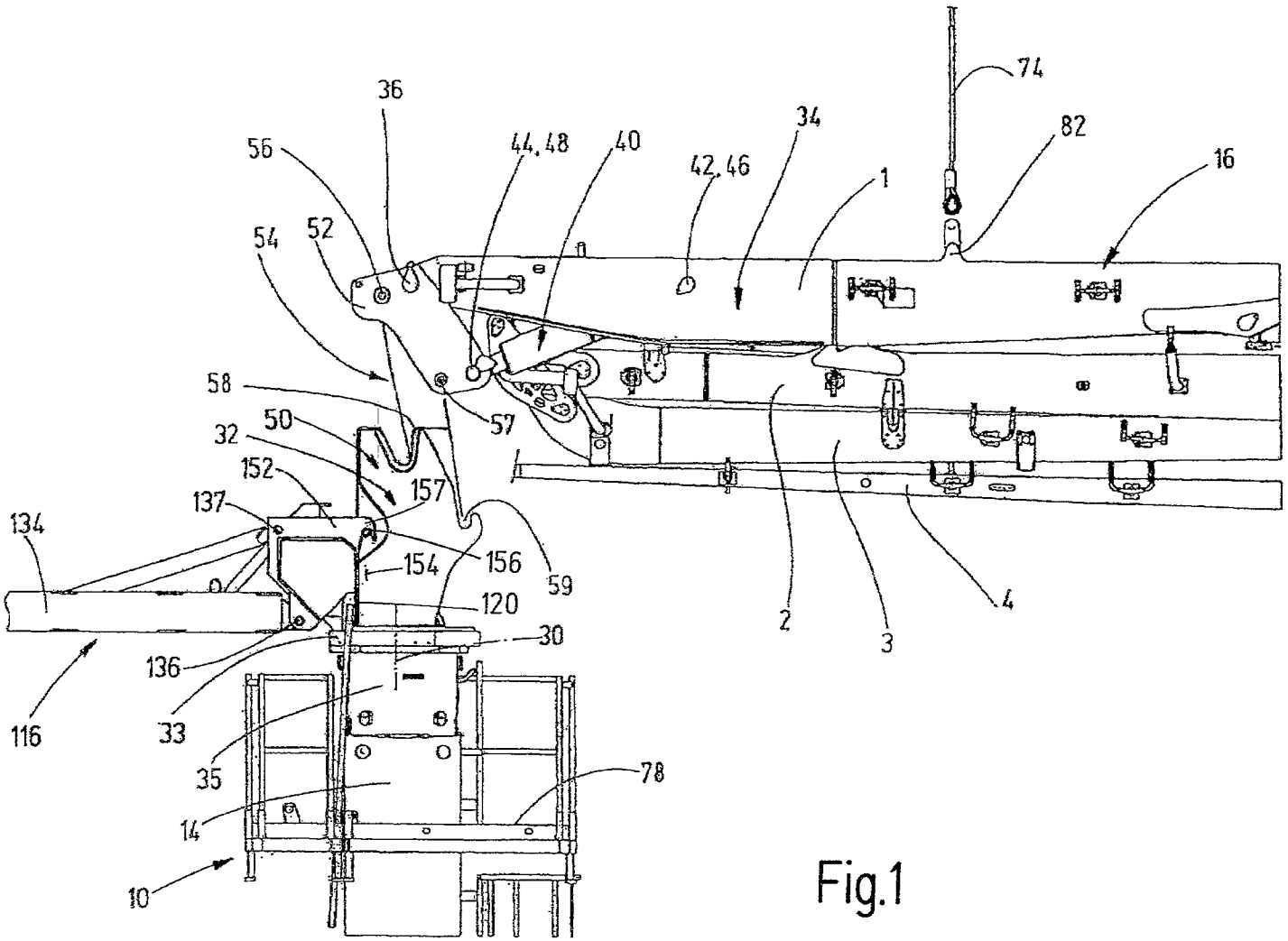
FIG. 1 shows an exploded illustration of a detail of a working device, configured as a concrete distributor boom, having a support column, arm assembly and ballast carrier.

The working device illustrated in the drawing is configured as a concrete pump having a stationary frame 10. The frame 10 forms a support column, which has at its upper end a substructure 14 with a bearing block 35 for a rotary head 32 that is rotatable about a vertical rotation axis 30. Arranged on the rotary head 32 are respective outriggers 16, 116 that are directed toward opposite sides of the support column and are configured as an arm assembly 34 and as a ballast carrier 134. The arm assembly 34 has a plurality of boom arms 1, 2, 3, 4 that are pivotable with respect to one another in pairs and carry a concrete delivery line 22. As can be seen in particular in FIGS. 1 and 4, the outrigger 16 with the first boom arm 1 of the arm assembly 34 is mounted in a pivotable manner about a horizontal pivot axis in the mounted state at a bearing point 36 of the rotary head 32. In order to be able to pivot the outrigger 16 with respect to the rotary head 32, provision is furthermore made of a hydraulic cylinder-piston unit 40 configured as a double-acting hydraulic cylinder, which is articulated with its end 42 fixed to the cylinder and with its end 44 fixed to the piston rod to an outrigger-side articulation point 46 arranged at a distance from the bearing point 36 and to a rotary-head-side articulation point 48 with a horizontal articulation axis, respectively.

The outrigger 16 configured as an arm assembly 34 of a concrete distributor boom is releasably coupled to the base part 50 of the rotary head 32 by means of coupling elements that are connectable together in a form-fitting manner in pairs via an adapter piece 52 at a separation point 54. For this purpose, the adapter piece 52 has coupling elements configured as pin-like drop-in elements 56, 57, while the base part 50 is provided with receptacles 58, 59, peripherally open upwardly, for the drop-in elements 56, 57. The bores, discernible in FIG. 1, in the adapter piece 52 form the bearing point 36 for the outrigger 16 and the rotary-head-side articulation point 48 for the cylinder-piston unit 40.

The outrigger 16 is transported to the frame 10 with the aid of a crane, which is fixed to the outrigger 16 at the centroid position 82 thereof via a crane gear 74. As can be seen from FIG. 4, provision is additionally made, in the region of the separation point 54, of a security device which is produced by means of a socket pin or latching pin 76 between the adapter piece 52 and the base part 50. The socket pin or latching pin 76 can be fitted subsequently by a fitter from a working platform 78 fixed to the substructure (FIG. 1).

Figure 4:
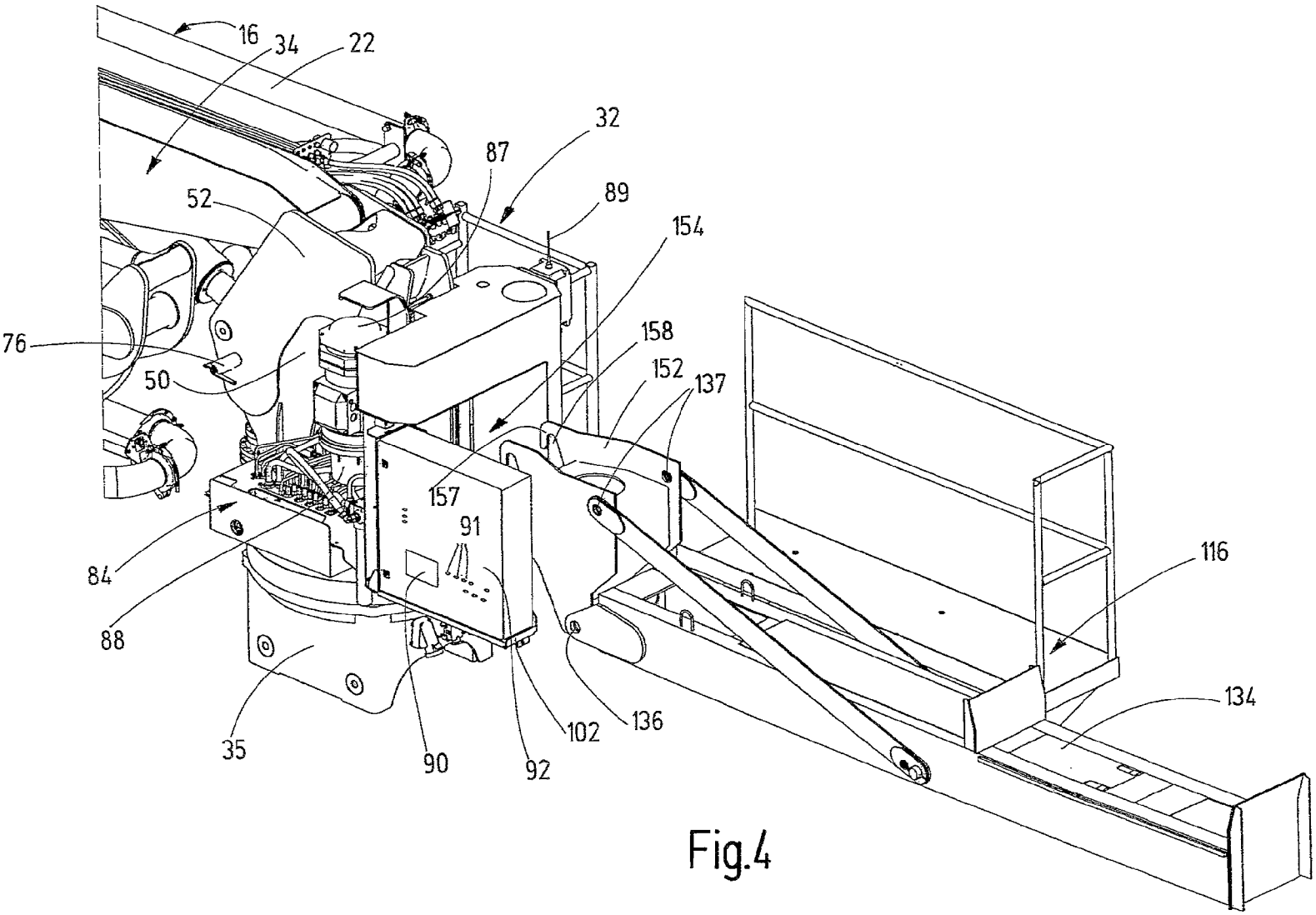
FIG. 4 shows a diagrammatic illustration of the rotary head with bearing block, arm assembly and ballast outrigger.

It can be seen in FIGS. 1 and 4 that the rotary head 32 has, in addition to the base part 50 arranged on the bearing block 35, a second adapter piece 152 comprising a bearing point 136 for an additional outrigger 116. The additional outrigger 116, having a ballast carrier 134, is releasably coupled to the base part 50 of the rotary head 32 by means of coupling elements that are connectable together in a form-fitting manner in pairs via the adapter piece 152 at the separation point 154.

In this case, a first group of coupling elements is configured as pin-like drop-in members 156 and a second group of coupling elements is configured as hooking members 157 provided with a peripherally open receptacle 158 for the drop-in members 156. The drop-in members 156 are arranged on the base part 50, while the hooking members 157 with a receptacle 158 that is peripherally open downwardly are arranged on the adapter piece 152. The adapter piece 152 has a stop 120 that is arranged beneath the peripherally open receptacle 158 in the mounted state and bears against the base part 50 under the action of the load torque generated about the axis of the drop-in members 156 via the outrigger 116. In the exemplary embodiment shown, the adapter piece 152 is connected to the outrigger 116 at two bearing points 136, 137, wherein the bearing points 136, 137 are spaced apart from one another primarily in the vertical direction. In a similar manner to the outrigger 16, the outrigger 116 can also be mounted on the base part 50 by means of a crane.

Figure 2A:
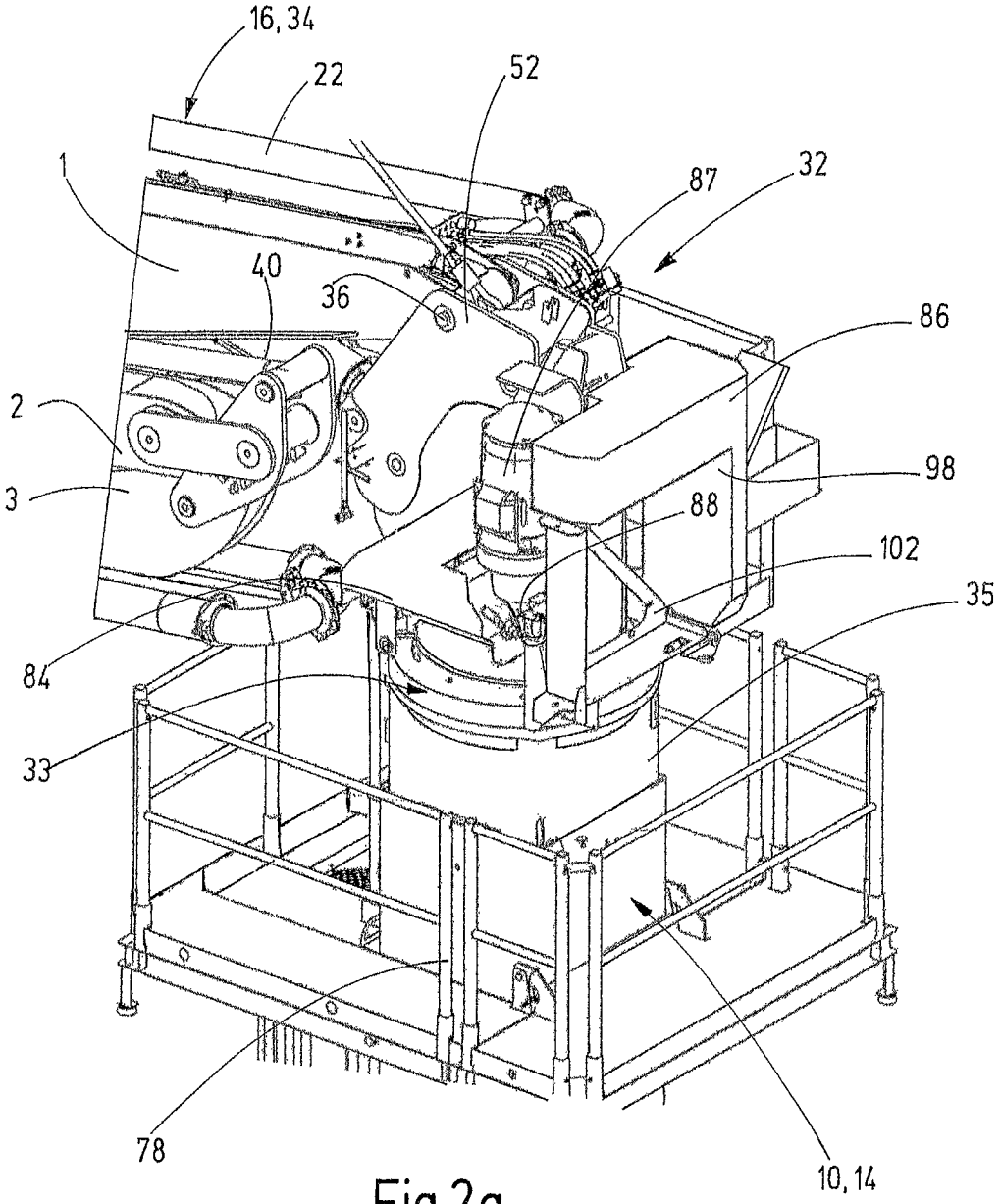
FIG. 2*a*, *b* and *c* show a diagrammatic illustration and two side views of a detail of the working device with fixtures on the rotary head.
Figure 2B:
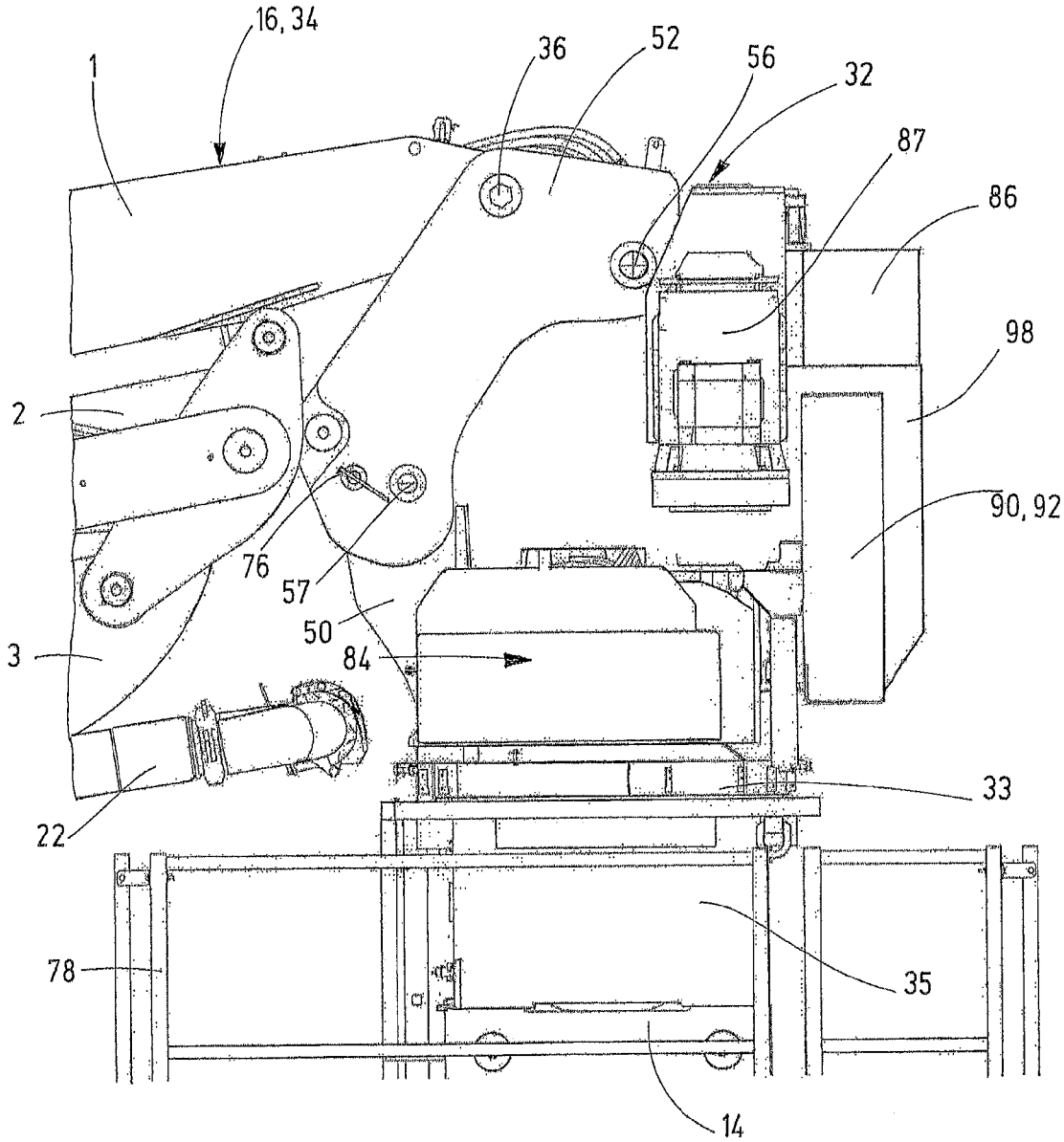
Figure 2C:
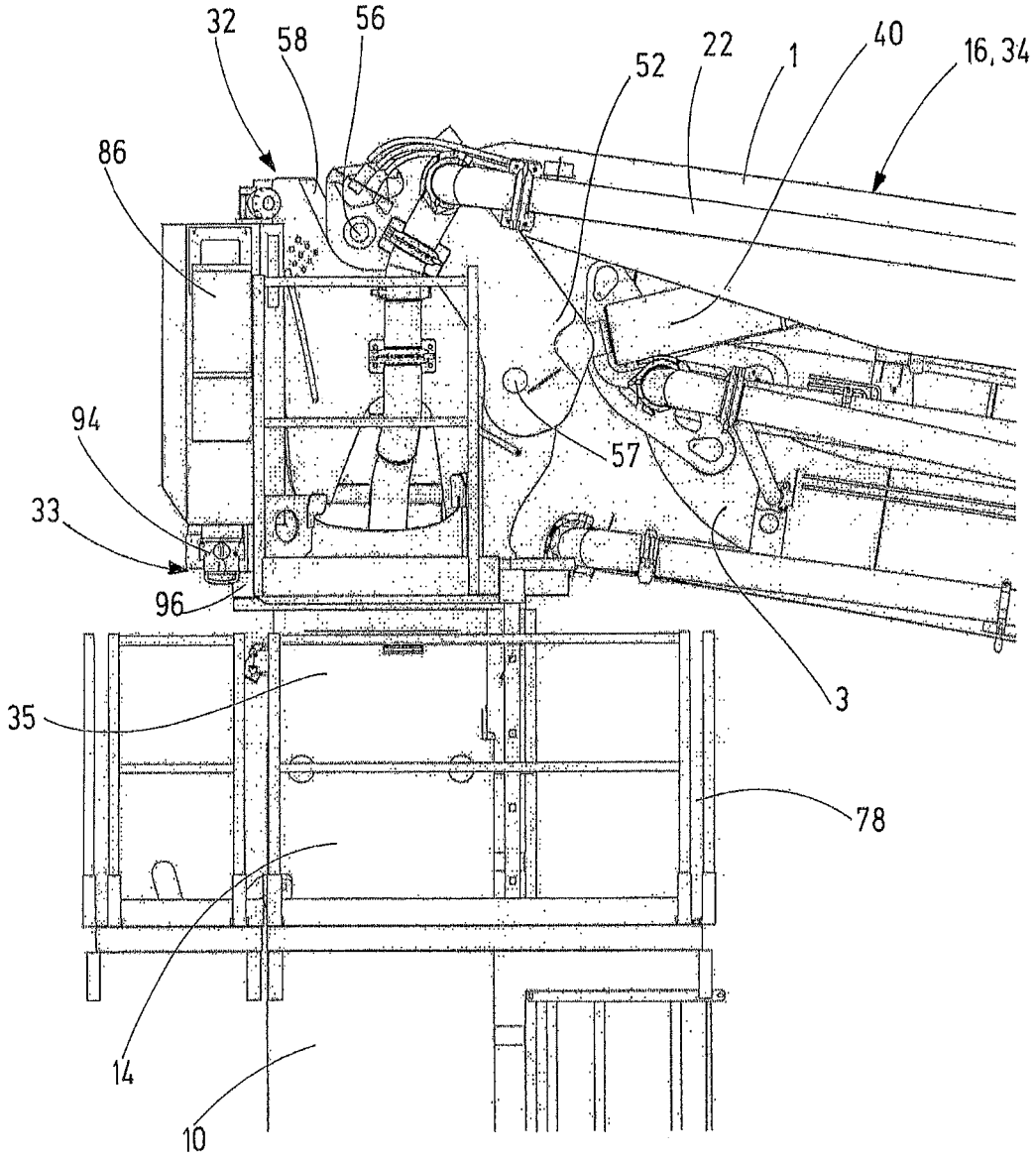
Figure 3B:
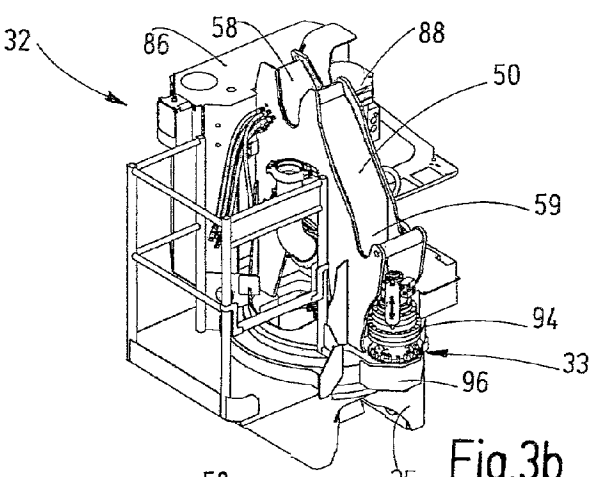
FIG. 3*a* to *d* show four different diagrammatic illustrations of the rotary head with fixtures, mounted on the bearing block.
Figure 3D:
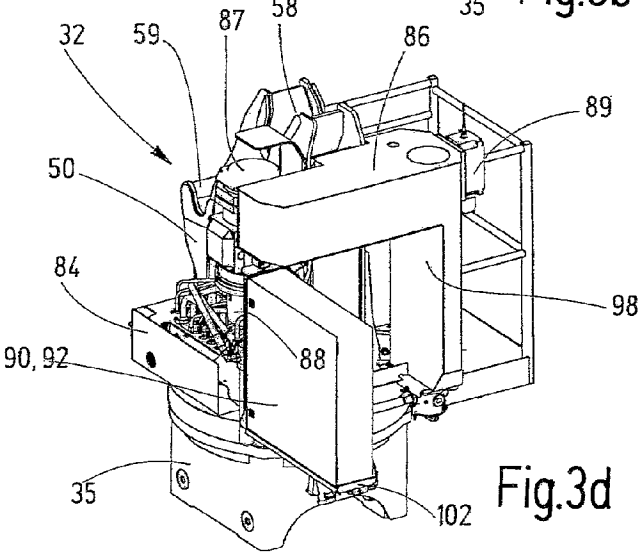
Figure 3A:
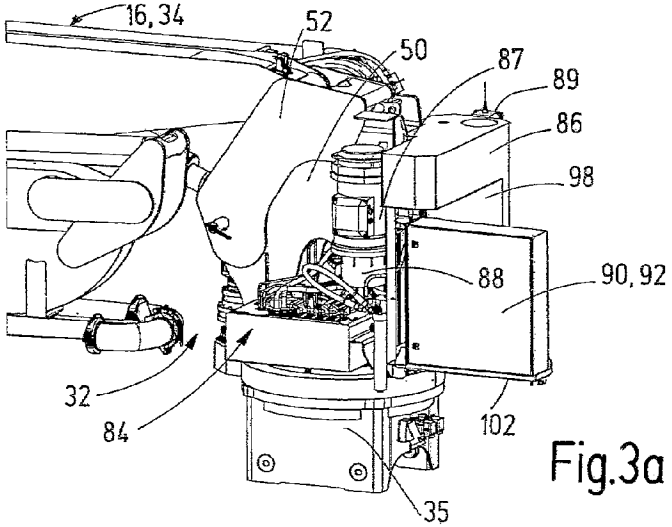
Figure 3C:
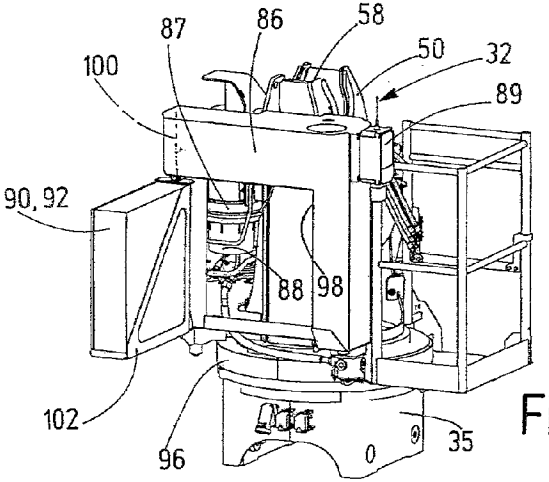

As can be seen from FIGS. 2 to 4, the rotary head is equipped with a relatively large number of fixtures, which have the following functions:

A hydraulic assembly 84 for controlling drive units for the rotary-head and boom-arm movement, said hydraulic assembly 84 having an oil tank 86 and a hydraulic pump 88 driven by means of an electric motor 87, a control mechanism 90 which is actuable either via control members 91 or a radio link 89 and is accommodated in a control cabinet 92, a drive mechanism 33 which has a hydraulic drive motor 94 and a slewing gearbox 96 for driving the rotary head 32 in rotation with respect to the bearing block 35, and a working platform 78 arranged in a manner fixed to the frame close to the bearing block 35.

One particular feature of the invention is that the control cabinet 92 with the control mechanism 90 and the hydraulic assembly 84 with the oil tank 86 and hydraulic pump 88 are arranged on the base part 50 of the rotary head 32 above the bearing block 35. Likewise arranged on the rotary head 32 above the bearing block 35 is the hydraulic drive motor 94 together with the slewing gearbox 96 for driving the rotary head 32. The control mechanism 90 is supplied with electric power via an external power source and an electrical cable that is routed via the support column fixed to the frame and bridges the rotary bearing between the bearing block 35 and rotary head 32.

A further particular feature of the invention is that the oil tank 86 has an external and internal contour that is geometrically matched to the rotary head 32. As can be seen in particular from FIGS. 3*a* to *d* and 4, the oil tank 86 is provided with a window 98 which is intended for the passage of a ballast outrigger 134 mounted on the rotary head 32. However, the ballast outrigger 134 only has to be provided when the frame 10 is loaded so heavily on account of the load torque acting on the rotary head 32 via the arm assembly 34 that load balancing is required. When a ballast outrigger 134 is not provided, the window 98 can be used to receive the control cabinet 92 for the control mechanism 90. In order to be ready for both cases, provision is made on the oil tank 86 of a holder 102 for receiving the control cabinet 92, said holder 102 being pivotable about an axis 100 parallel to the rotation axis 30 of the rotary head 32 with respect to the window 98. In this way it is possible, when the ballast outrigger 134 is present, to pivot the control cabinet 92 out of the window 98 via its holder 102, such that it can be operated from the working platform 78.

With the construction according to the invention, as a result of which the operationally necessary fixtures, such as the control cabinet 92, hydraulic assembly 88 and drive mechanism 33, are arranged directly on the rotary head 32 above the bearing block 35, the freedom of movement of the fitter in the region of the working platform 78 is improved. The working platform 78 free of fixtures allows the fitter to move around without stumbling when rotating the rotary head 32 and also allows a good view of the arm assembly 34. As a result of the omission of the disruptive fixtures, the arm assembly 34 can furthermore be placed close to the rotary head 32, with the result that the load torque generated thereby and thus the deflection of the frame 10 can be reduced.

In summary: the invention relates to a working device having a frame 10 configured as a stationary support column, having a motor-driven rotary head 32 and having an arm assembly 34 consisting of a plurality of boom arms 1, 2, 3, 4 that are movable in pairs relative to one another at articulated joints or sliding joints and carry a concrete delivery line. The arm assembly 34 is articulated on the rotary head 32 about a horizontal rotation axis 30 with its first boom arm 1. Provision is furthermore made of a control mechanism 90 that is actuable via control members or a radio link and is arranged in a control cabinet 92, and a hydraulic assembly 84, having an oil tank 86 and a motor-driven hydraulic pump 88, for controlling drive units for the rotary-head and boom-arm movement. For emergency operation, a working platform 78 arranged in a manner fixed to the frame is located in the vicinity of the bearing block 35. In order to ensure that the fixtures necessary for actuating the arm assembly 34 do not disrupt the operator in the event of emergency operation, the invention proposes that the control cabinet 92 with the control mechanism 90 and the hydraulic assembly 84 with the oil tank 86 and hydraulic pump 88 are arranged on the rotary head 32 above the bearing block 35.

LIST OF REFERENCE SIGNS

1, 2, 3, 4 Boom arms
10 Frame
14 Substructure
16 Outrigger
22 Concrete delivery line
30 Rotation axis
32 Rotary head
33 Drive mechanism
34 Arm assembly
35 Bearing block
36 Bearing point
40 Cylinder-piston unit
42 End fixed to the cylinder
44 End fixed to the piston rod
46, 48 Articulation points
50 Base part
52 Adapter piece
54 Separation point
56, 57 Drop-in elements
58, 59 Receptacles
74 Crane gear
76 Latching pin
78 Working platform
82 Centroid position
84 Hydraulic assembly
86 Oil tank
87 Electric motor
88 Hydraulic pump
89 Radio link
90 Control mechanism
91 Control members
92 Control cabinet
94 Drive motor
96 Slewing gearbox
98 Window
100 Axis
102 Holder
116 Outrigger
134 Ballast carrier
136, 137 Bearing points
152 Adapter piece
154 Separation point
156 Drop-in member
157 Hooking member
158 Receptacles

The invention claimed is:

1. A working device having a frame configured preferably as a stationary support column, having a motor-driven rotary head which is arranged on a bearing block, fixed to the frame, so as to be rotatable about a vertical rotation axis, having an arm assembly comprising a plurality of boom arms that are movable in pairs relative to one another at articulated joints or sliding joints and carry a concrete delivery line, which arm assembly is articulated on the rotary head about a horizontal rotation axis with its first boom arm, having a control mechanism that is actuable either via control members or a radio link and is arranged in a control cabinet, and a hydraulic assembly, having an oil tank and a motor-driven hydraulic pump, for controlling drive units for the rotary-head and boom-arm movement, and having a working platform arranged in a manner fixed to the frame in the vicinity of the bearing block, whereby the control cabinet with the control mechanism and the hydraulic assembly with the oil tank and hydraulic pump are arranged on the rotary head above the bearing block, wherein the oil tank has a window for receiving the control cabinet, and wherein the control cabinet is arranged on a holder which is pivotable about an axis parallel to the rotation axis of the rotary head with respect to the window.

2. The working device as claimed in claim 1, wherein the rotary head is rotatable with respect to the bearing block by means of a hydraulic or electric drive motor and a slewing gearbox, wherein the drive motor and the slewing gearbox are arranged on the rotary head above the bearing block.

3. The working device as claimed in claim 1, wherein the hydraulic pump is drivable by means of an electric motor arranged on the rotary head.

4. The working device as claimed in claim 1, wherein the control mechanism is supplied with electric power via an external power source and an electrical cable that is routed via the support column and bridges the rotary connection between the bearing block and rotary head.

5. The working device as claimed in claim 1, wherein the oil tank has an external and internal contour that is geometrically matched to the rotary head.

6. The working device as claimed in claim 5, wherein the oil tank has a window with an internal contour that forms the passage for a ballast outrigger mounted on the rotary head.

7. The working device as claimed in claim 1, wherein the rotary head has a base part arranged on the bearing block and an adapter piece comprising a bearing point for the arm assembly, wherein the base part and the adapter piece are coupled together releasably at a separation point.

8. A working device having a frame configured preferably as a stationary support column, having a motor-driven rotary head which is arranged on a bearing block, fixed to the frame, so as to be rotatable about a vertical rotation axis, an outrigger arranged on said rotary head and being configured as an arm assembly comprising a plurality of boom arms that are movable in pairs relative to one another at articulated joints or sliding joints and carry a concrete delivery line, which arm assembly is articulated on the rotary head about a horizontal rotation axis with its first boom arm, having a control mechanism that is actuable either via control members or a radio link and is arranged in a control cabinet, and a hydraulic assembly, having an oil tank and a motor-driven hydraulic pump, for controlling drive units for the rotary-head and boom-arm movement, and having a working platform arranged in a manner fixed to the frame in the vicinity of the bearing block, whereby the control cabinet with the control mechanism and the hydraulic assembly with the oil tank and hydraulic pump are arranged on the rotary head above the bearing block, wherein the rotary head has a base part arranged on the bearing block and an adapter piece comprising a bearing point for the arm assembly, wherein the base part and the adapter piece are coupled together releasably at a separation point, wherein bores in the adaptor piece from the bearing point for the outrigger and form the rotary-head-side articulation point fixed to a head of a cylinder piston unit, which is fixed at a distance from the bearing point for the outrigger.

9. The working device as claimed in claim 7, wherein the base part and the adapter piece have coupling elements that are connectable together in a form-fitting manner in pairs at their separation point.

10. The working device as claimed in claim 6, wherein the ballast outrigger is coupled releasably to the base part of the rotary head by means of further coupling elements that are connectable together in a form-fitting manner in pairs via a further adapter piece at a second separation point located opposite the separation point of the arm assembly.

* * * * *